US010260679B2

(12) United States Patent
Wyllie et al.

(10) Patent No.: US 10,260,679 B2
(45) Date of Patent: Apr. 16, 2019

(54) LNG EXPORT TERMINAL

(71) Applicant: SBM Schiedam B.V., Schiedam (NL)

(72) Inventors: Michael Wyllie, Monaco (MC); Theodorus Johannes Bernardus Brinkel, Rijswijk (NL)

(73) Assignee: Single Buoy Moorings Inc., Marly (CH)

( * ) Notice: Subject to any disclaimer, the term of this patent is extended or adjusted under 35 U.S.C. 154(b) by 572 days.

(21) Appl. No.: 14/153,403

(22) Filed: Jan. 13, 2014

(65) Prior Publication Data

US 2015/0198288 A1 Jul. 16, 2015

(51) Int. Cl.
*F17C 3/00* (2006.01)
*F17C 6/00* (2006.01)

(52) U.S. Cl.
CPC ..... *F17C 6/00* (2013.01); *F17C 2201/0128* (2013.01); *F17C 2221/033* (2013.01); *F17C 2223/0161* (2013.01); *F17C 2270/0105* (2013.01); *F17C 2270/0113* (2013.01); *F17C 2270/0123* (2013.01); *F17C 2270/0136* (2013.01)

(58) Field of Classification Search
CPC .. F17C 2270/0105; F17C 3/025; F17C 1/002; F17C 13/082; F25J 1/0277; F25J 2290/70; F25J 2290/72; F25J 1/0275
USPC ..... 62/606
See application file for complete search history.

(56) References Cited

U.S. PATENT DOCUMENTS 6,434,948 B1 * 8/2002 Eide ..... B63B 27/24 62/240
6,546,739 B2 * 4/2003 Frimm ..... B63B 27/24 62/240
7,360,367 B2 * 4/2008 Hubbard ..... F17C 3/04 141/387
7,464,734 B2 * 12/2008 Liu ..... F16L 59/141 141/290
2005/0193938 A1 * 9/2005 Boatman ..... B63B 21/50 114/230.1
2007/0144184 A1 * 6/2007 Wijingaarden ..... F17C 5/06 62/50.2
2008/0127673 A1 * 6/2008 Bowen ..... F17C 5/00 62/611
2008/0190352 A1 * 8/2008 Lee ..... F17C 3/00 114/74 A
2013/0283825 A1 * 10/2013 Bernays ..... B63B 35/44 62/53.2

* cited by examiner

*Primary Examiner* — David J Teitelbaum
(74) *Attorney, Agent, or Firm* — N.V. Nederlandsch Ostrooibureau; Catherine A. Shultz

(57) ABSTRACT

A near shore liquefied natural gas (LNG) export terminal includes an LNG storage unit, a jetty and a converted hydrocarbon carrier-vessel moored against the jetty. The carrier-vessel includes a hull, at least one hydrocarbon storage tank and is provided with a natural gas processing system for liquefying natural gas. Onshore produced natural gas is supplied through a first pipeline to the natural gas processing plant on the carrier-vessel and the LNG produced by the natural gas processing system is transferred from the carrier-vessel to the LNG storage unit via a second pipeline suitable for the transfer of cryogenic fluids.

16 Claims, 5 Drawing Sheets

LNG EXPORT TERMINAL

FIELD OF THE INVENTION

The present invention relates to an near shore LNG export terminal, comprising a floating natural gas processing system and an LNG storage unit.

BACKGROUND

Such terminals have been described in the prior art. U.S. Pat. No. 2,940,268, for example, teaches to liquefy of natural gas in a barge mounted liquefaction plant and to subsequent discharge the liquefied natural gas into suitably insulated storage tanks, preferably installed on a tank carrying vessel. The barges described in U.S. Pat. No. 2,940,268 are often custom made in specialized wharfs and they mostly lack proper propulsion to reach their operational destination, so that they need to be towed or transported, sometimes over large distances. The risk of damage to the barge during the journey to the operational destination is clear and present. Furthermore, the facilities provided on the barge are limited and it may be necessary to provide extensive facilities onshore. Providing facilities onshore is difficult and/or requires important investments on some operational sites.

SUMMARY OF THE INVENTION

It is an object of the present invention is to provide an improved liquefied natural gas (LNG) export terminal which reduces the disadvantages and limitations of the LNG export terminals, known from the prior art.

Thereto, the near shore liquefied natural gas (LNG) export terminal comprising an LNG storage unit, a jetty and a converted hydrocarbon carrier-vessel moored against the jetty, the carrier-vessel comprising a hull, at least one hydrocarbon storage tank and being provided with a natural gas processing system for liquefying natural gas, wherein onshore produced natural gas is supplied through a first pipeline to the natural gas processing plant on the converted hydrocarbon carrier-vessel, the converted hydrocarbon carrier vessel is arranged to receive the onshore produced natural gas and to transfer the LNG produced by the natural gas processing system from the carrier-vessel to the LNG storage unit via a second pipeline suitable for the transfer of cryogenic fluids.

The inventors have observed that instead of using a flat-top barge, as described in the prior art, the use of a converted hydrocarbon carrier-vessel as a platform for the natural gas processing system for liquefying natural gas offers the advantage that some functionalities of the converted hydrocarbon carrier-vessel can be re-used and have to be newly built on a flat-top barge, such as, but not limited to, a deckhouse for operational people on board, possibly only during dayshift, going home after work, supporting facilities for people on-board (drinking water, sewage treatment), safety systems in the accommodation area, boiler (to provide process heat and for start-up), and emergency power supply.

Other functionalities such as propulsion, for sailing on own power from the conversion/assembly yard to the final operational destination, are available as well. Within the frame-work of the present invention, it will be appreciated that the term "jetty-moored" encompasses also quay-moored or any other near-shore mooring.

The liquefaction process in the natural gas processing system involves removal of certain components, such as dust, acid gases, helium, water, and heavy hydrocarbons, that could cause difficulty downstream. The natural gas is then condensed into a liquid at close to atmospheric pressure (maximum transport pressure set at around 25 kPa (4 psi)) by cooling it to approximately −162° C. (−260° F.).

According to an embodiment of the present invention, the LNG storage unit comprises one or a plurality of onshore LNG storage tanks.

According to an embodiment of the present invention, the onshore LNG storage tank is connectable through a further pipeline to an LNG shuttle tanker.

According to an embodiment of the present invention, the LNG storage unit comprises an LNG storage tanker having storage tanks for containing LNG.

According to an embodiment of the present invention, the storage tanks are spherical tanks.

According to an embodiment of the present invention, the LNG storage tanks are membrane tanks.

According to an embodiment of the present invention, the LNG storage tanker is connectable through a further pipeline to a further LNG shuttle tanker.

According to an embodiment of the present invention, the converted hydrocarbon carrier-vessel further comprises one or more facilities selected from a group comprising living quarters, maintenance facilities, safety systems, emergency escape and evacuation systems, logistic systems and power generation systems. According to an embodiment of the present invention, the converted hydrocarbon carrier-vessel is a converted oil tanker.

According to an embodiment of the present invention, the converted oil tanker is a converted very large crude carrier (VLCC).

According to an embodiment of the present invention, the converted hydrocarbon carrier-vessel is a converted LNG carrier.

According to an embodiment of the present invention, the second and further pipelines are cryogenic hoses.

Advantageous embodiments are further defined by the dependent claims.

BRIEF DESCRIPTION OF DRAWINGS

Presently preferred embodiments are described below in conjunction with the appended drawing figures, wherein like reference numerals refer to like elements in the various figures, and wherein.

DETAILED DESCRIPTION OF EMBODIMENTS

Figure 1:
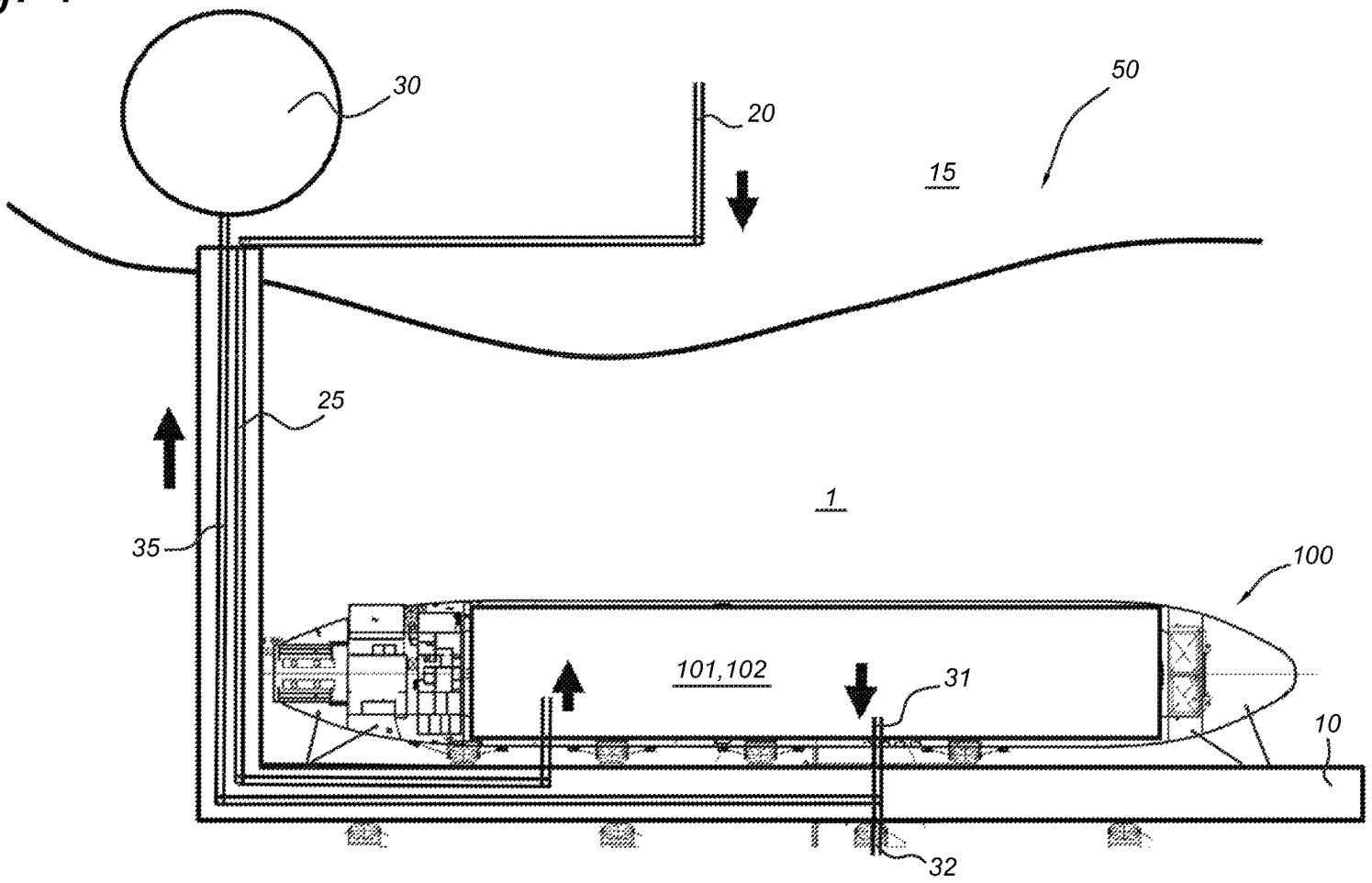
FIG. 1 illustrates an LNG export terminal with a converted hydrocarbon carrier and an onshore placed LNG storage tank.

The present invention will be described with respect to particular embodiments and with reference to certain drawings but the invention is not limited thereto. The drawings described are only schematic and are non-limiting. In the drawings, the size of some of the elements may be exaggerated and not drawn on scale for illustrative purposes.

Furthermore, the terms first, second, third and the like in the description are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under and the like in the description are used for descriptive purposes and not necessarily for describing relative positions. The terms so used are interchangeable under appropriate circumstances and the embodiments of the invention described herein can operate in other orientations than described or illustrated herein.

The term "comprising" should not be interpreted as being restricted to the means listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting of only components A and B. It means that with respect to the present description, the only relevant components of the device are A and B.

FIG. 1 schematically shows an LNG export terminal 50 with a converted hydrocarbon carrier-vessel 100 and an onshore placed LNG storage tank 30 in accordance with an embodiment of the present invention.

The LNG export terminal 50 comprises a converted hydrocarbon carrier-vessel 100, an LNG storage unit 30 and a jetty 10.

The converted hydrocarbon carrier-vessel 100 is arranged in coastal water 1 of a sea or a lake and is moored against the jetty 10, relatively close to shore 15.

The converted hydrocarbon carrier-vessel 100 comprises a hull, and is provided with a natural gas processing system (liquefaction system) 101 for liquefying natural gas.

The liquefaction system 101 typically comprises at least one hydrocarbon storage tank 102.

From a source 20, onshore produced natural gas is supplied through a first pipeline 25 to an input 21 of the natural gas processing plant 101, 102 on the converted hydrocarbon carrier-vessel 100.

The converted hydrocarbon carrier-vessel 100 is arranged to receive the onshore produced natural gas, to produce LNG in the liquefaction system 101, 102 and to transfer from an output 31 of the liquefaction system, the LNG product to the onshore LNG storage unit 30 via a second pipeline 35 suitable for the transfer of cryogenic fluids.

In an embodiment, both the first and second pipelines 25, 35, run along the jetty between the converted hydrocarbon carrier-vessel 100 and the shore 15.

It is noted that alternatively the converted hydrocarbon carrier-vessel could be spread-moored or turret-moored.

In an embodiment the converted hydrocarbon carrier-vessel is either a converted oil tanker, or a converted very large crude carrier (VLCC) or a converted LNG carrier.

In an embodiment, the first and/or second pipelines 25, 35 may be embodied as cryogenic hoses.

Further, as schematically indicated, the converted hydrocarbon carrier-vessel 100 may comprise facilities such as one or more of living quarters, maintenance facilities, safety systems, emergency escape and evacuation systems, logistic systems and one or more power generation systems.

Figure 2:
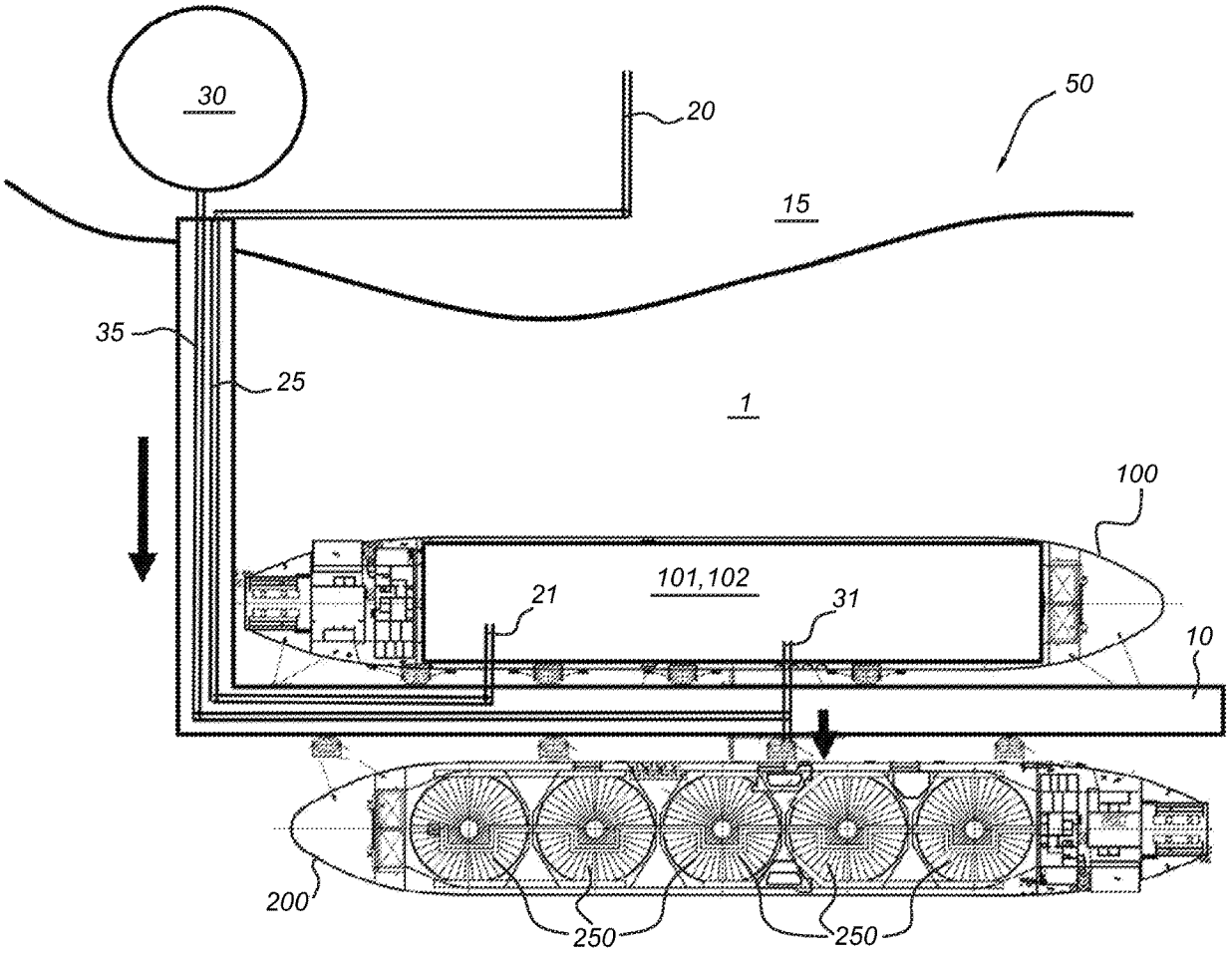
FIG. 2 illustrates the LNG export terminal of FIG. 1 with an LNG shuttle carrier moored against the jetty and receiving LNG from the onshore LNG storage tank.

FIG. 2 schematically shows the LNG export terminal 50 in accordance with a further embodiment.

In this embodiment the LNG export terminal is configured to receive an LNG shuttle tanker or vessel 200 that functions as an offshore LNG storage unit and LNG carrier.

The LNG shuttle tanker 200 is arranged with LNG storage tanks 250 for storing LNG.

The LNG export terminal's jetty 10 is configured for mooring of the LNG shuttle tanker 200. Additionally, the second pipeline 25 is arranged with an LNG product outlet 32 that can be coupled to an input of the LNG shuttle tanker 200, in such a way that the LNG shuttle tanker can receive LNG from the onshore LNG storage tank 30.

In a further embodiment, the second pipeline 35 may be configured to allow direct transfer of LNG from output 31 of the converted hydrocarbon carrier-vessel 100 to outlet 35 coupled to the LNG shuttle tanker 200.

Optionally, the converted hydrocarbon carrier-vessel 100 may be configured to have the LNG shuttle tanker 200 mooring along the hull.

Figure 3:
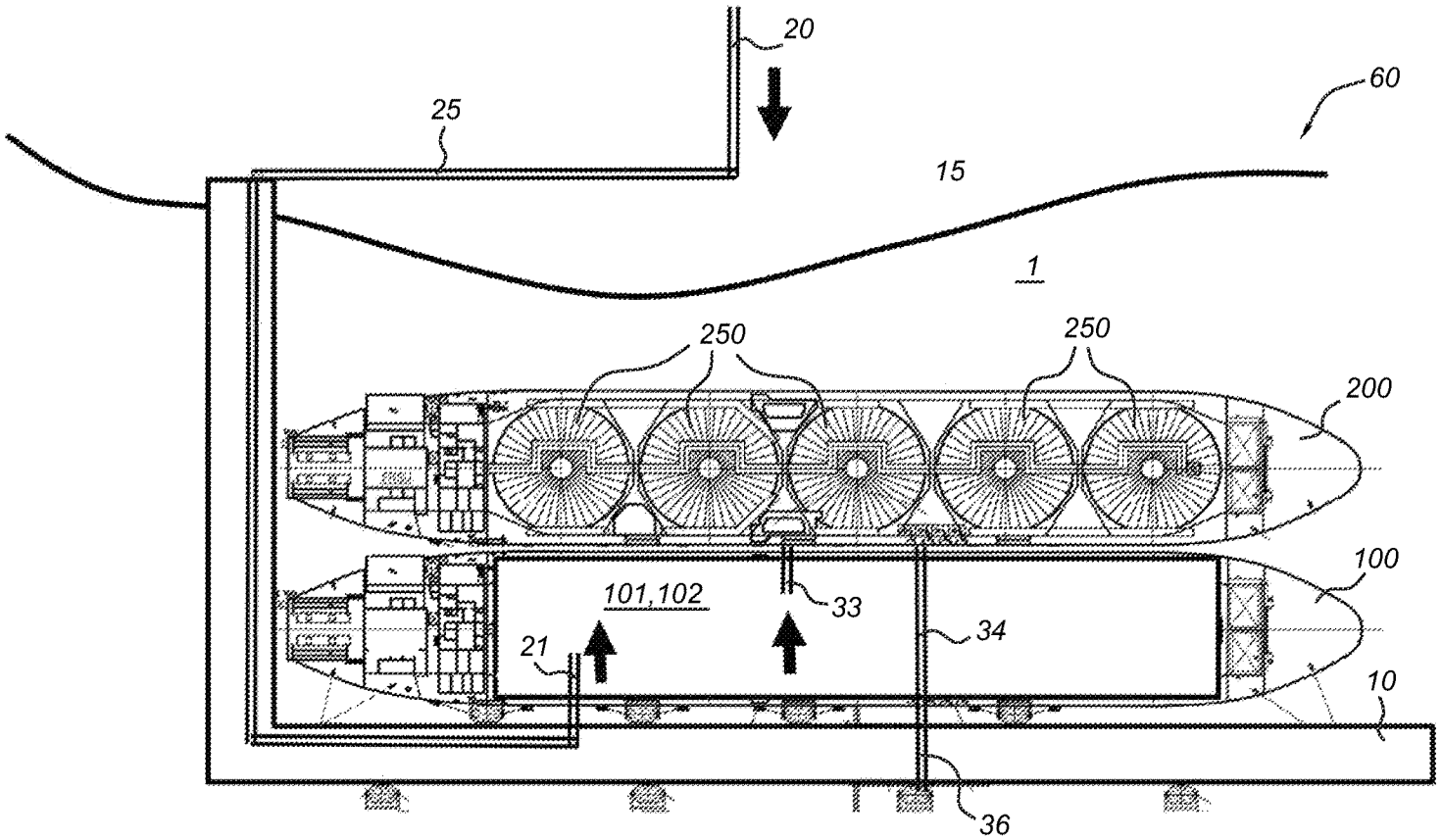
FIG. 3 illustrates an alternative LNG export terminal with a converted hydrocarbon carrier and an moored LNG storage vessel for storage of the produced LNG.

FIG. 3 schematically shows an LNG export terminal 60 in an alternative embodiment.

In this embodiment, the onshore LNG storage tank 30 is omitted and replaced by a first LNG storage vessel 200 that functions as an LNG storage unit.

The first LNG storage vessel 200 may be an LNG shuttle tanker or an LNG storage tanker, and is arranged with LNG storage tanks 250 for storing LNG.

In this embodiment, the converted hydrocarbon carrier-vessel 100 is moored against the jetty 10 and has the capability to have the first LNG storage vessel 200 mooring along its free side of the hull.

Alternatively, the first LNG storage vessel 200 may be moored against the jetty 10 with the converted hydrocarbon carrier-vessel 100 mooring along a free side of the hull of the first LNG storage vessel 200.

In a further alternative, the converted hydrocarbon carrier-vessel 100 and the first LNG storage vessel 200 are arranged lengthwise in line (or in tandem), each moored against the same side of the jetty 10.

From the source 20, onshore produced natural gas is supplied through the first pipeline 25 to the input 21 of the natural gas processing plant 101, 102 on the converted hydrocarbon carrier-vessel 100.

The converted hydrocarbon carrier-vessel 100 is arranged to produce LNG in the liquefaction system 101, 102 and to transfer from the liquefaction system, the LNG product directly to the LNG storage tanks 250 on the first LNG storage vessel 200 via a second pipeline 33.

Additionally, the first LNG storage vessel 200 is equipped with a further pipeline 34 is arranged with an LNG product outlet 36 that can be coupled to an input of a further LNG shuttle vessel (not shown) that can moor along the jetty 10. In this manner, the first LNG shuttle carrier vessel can function as an LNG storage tank, while the further LNG shuttle vessel is used a carrier for the LNG product. This can be advantageous in locations where it is difficult to construct an onshore LNG storage.

Figure 4:
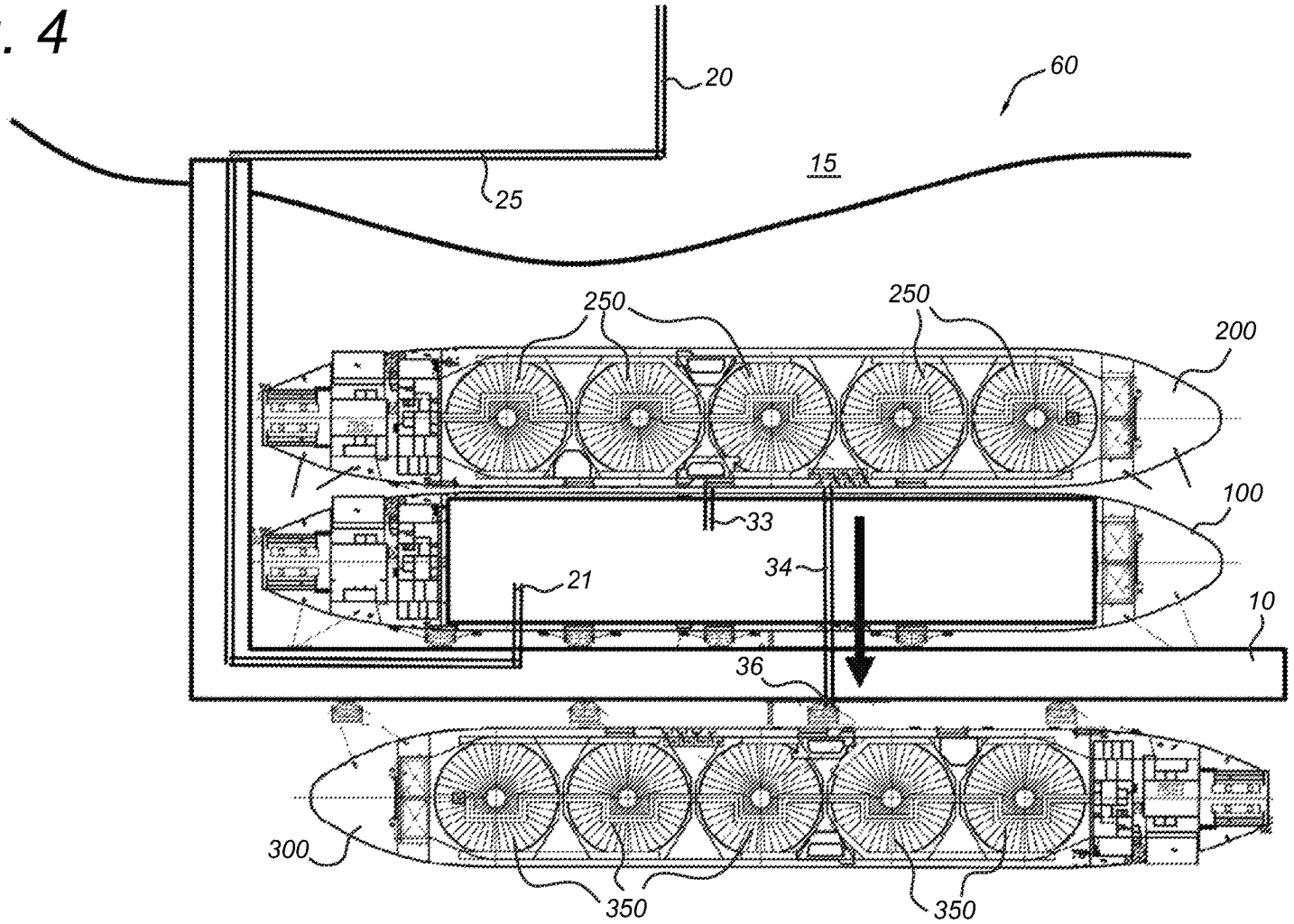
FIG. 4 illustrates the alternative LNG export terminal of FIG. 3 with a moored LNG shuttle carrier receiving the produced and stored LNG from the LNG storage tanker.

FIG. 4 illustrates the alternative LNG export terminal 60 of FIG. 3. A further LNG shuttle vessel 300 is moored at the jetty 10. The further LNG shuttle vessel 300 comprises LNG storage tanks 350 for storing LNG.

During loading, the LNG storage system on the further LNG shuttle vessel 300 is coupled via the further pipeline 36 with the first LNG shuttle vessel 200 that functions as LNG storage.

In this manner the moored further LNG shuttle vessel 300 is arranged to receive the produced and/or stored LNG either from the liquefaction system 101, 102 converted hydrocarbon carrier-vessel 100 directly or from the LNG storage on the first LNG shuttle vessel 200.

Figure 5:
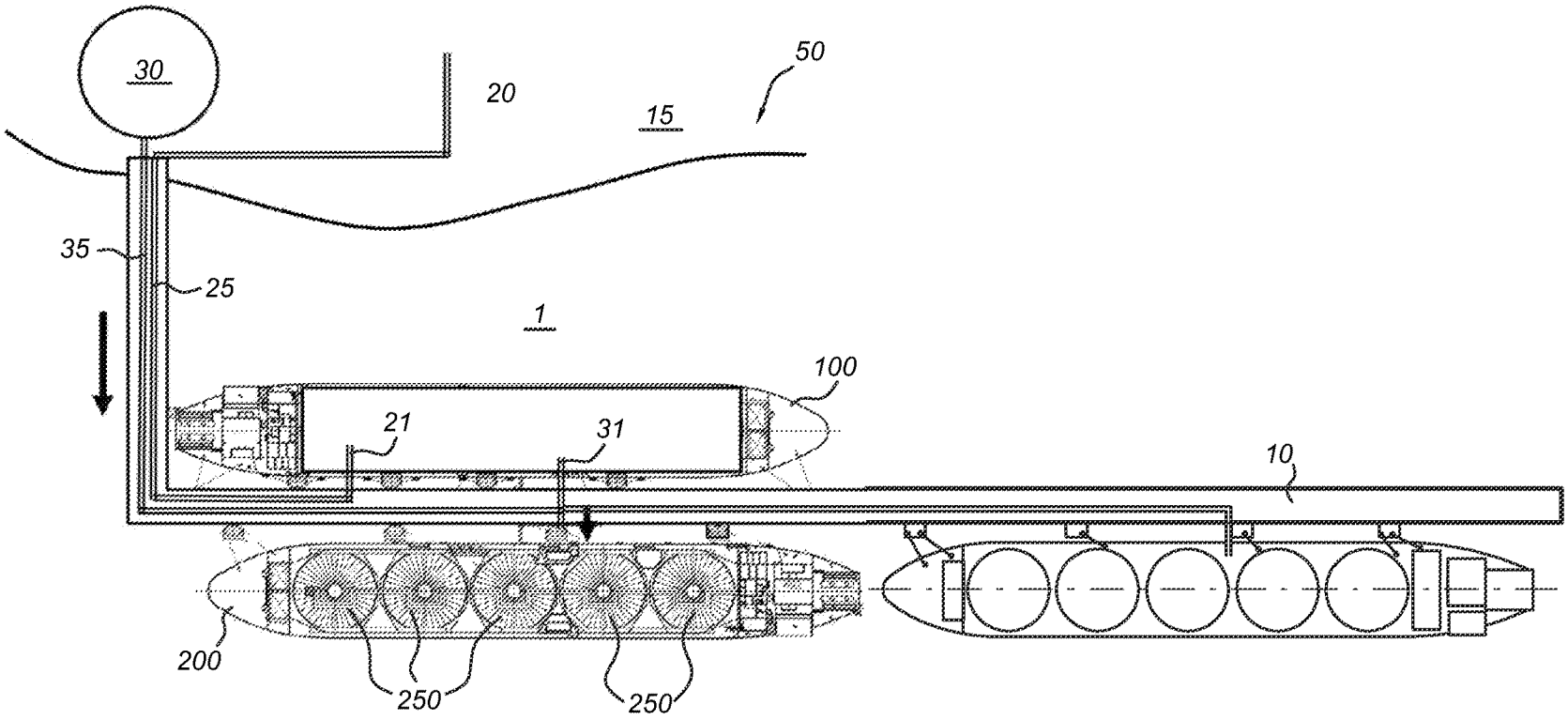
FIG. 5 schematically shows an LNG export terminal according to a further embodiment.

FIG. 5 schematically shows an LNG export terminal according to a further embodiment. In this embodiment, the LNG export terminal 50; 60 is arranged to receive additional LNG shuttle tankers 200 at the jetty 10 at a same time. The LNG shuttle tankers can be moored in line against the jetty.

The pipeline(s) 35 of the LNG export terminal handling the produced LNG are adapted with additional outlets to allow multiple LNG shuttle tankers to be served at the same time. In dependence on the specific embodiment, the tankers can be loaded from either the onshore LNG storage 30, the LNG storage vessel 200 or directly from the liquefaction system 101, 102 onboard the converted hydrocarbon carrier-vessel 100 or in a combination thereof.

According to the invention, the pipelines 25; 35 as described above may be pipelines suitable for cryogenic substances or may be cryogenic hoses. Instead of a jetty 10, the LNG export terminal may comprise a quay or a breakwater type or a mooring arrangement with dolphin type mooring construction for mooring the converted hydrocarbon carrier vessel or in some embodiments, the first LNG storage vessel.

The foregoing description details certain embodiments of the invention. It will be appreciated, however, that no matter how detailed the foregoing appears in text, the invention may be practiced in many ways. It should be noted that the use of particular terminology when describing certain features or aspects of the invention should not be taken to imply that the terminology is being re-defined herein to be restricted to including any specific characteristics of the features or aspects of the invention with which that terminology is associated.

While the above detailed description has shown, described, and pointed out novel features of the invention as applied to various embodiments, it will be understood that various modifications in the form and details of the device or process illustrated may be made by those skilled in the technology without departing from the spirit of the invention. The scope of the invention is indicated by the appended claims rather than by the foregoing description. All modifications that come within the meaning and range of equivalency of the claims are to be embraced within their scope.

The invention claimed is:

1. A liquefied natural gas export terminal for export of onshore produced natural gas supplied by a source that is arranged on a shore, said source supplying the onshore produced natural gas to the liquefied natural gas LNG export terminal, the liquefied natural gas export terminal comprising:

a liquefied natural gas storage unit, a jetty, a first pipeline that runs along the jetty, a converted hydrocarbon carrier-vessel, spaced apart from the liquefied natural gas storage unit and moored directly against the jetty, the jetty extending from shore and extending at a ninety degree angle to have a jetty portion extending parallel to the coastline to form an L-shape, the converted hydrocarbon carrier-vessel moored directly against the jetty on a shore side of the jetty with a length of the converted hydrocarbon carrier-vessel parallel to the jetty portion extending parallel to the coastline, and an outlet to export liquefied natural gas to a tanker, the outlet located on the jetty portion extending parallel to the coastline on a side of the jetty opposite the converted hydrocarbon carrier-vessel such that a vessel can moor to the jetty to receive liquefied natural gas through the outlet;

wherein the first pipe line runs on the jetty and is supported by the jetty in a lengthwise direction from the shore to the hydrocarbon carrier vessel, wherein the converted hydrocarbon carrier-vessel is a converted oil tanker or a converted liquefied natural gas carrier and comprises a hull, a natural gas processing system, and at least one hydrocarbon storage tank located within the hull, and a second pipeline suitable for the transfer of cryogenic fluids extending from the converted hydrocarbon carrier-vessel that is moored to the jetty to the liquefied natural gas LNG storage unit, wherein the first pipeline is arranged for supplying the onshore produced natural gas from the source to the natural gas processing system on the converted hydrocarbon carrier-vessel, and wherein the converted hydrocarbon carrier vessel is arranged to receive the onshore produced natural gas, liquefy the received onshore produced natural gas in the natural gas processing system, and to transfer the liquefied natural gas produced by a natural gas processing system from the converted hydrocarbon carrier-vessel to the liquefied natural gas storage unit or to the outlet via the second pipeline.

2. The liquefied natural gas export terminals according to claim 1, wherein the liquefied natural gas storage unit is a liquefied natural gas storage tanker having storage tanks for the produced liquefied natural gas and which is moored directly against the jetty or against the converted hydrocarbon carrier-vessel.

3. The liquefied natural gas export terminals according to claim 2, wherein the storage tanks are spherical tanks.

4. The liquefied natural gas export terminal according to claim 2, wherein the liquefied natural gas storage tanks are membrane tanks.

5. The liquefied natural gas export terminal according to claim 2, wherein the liquefied natural gas storage tanker is connectable through a cryogenic pipeline or hose to one of a group consisting of i) a liquefied natural gas shuttle tanker that is temporarily moored against the jetty, ii) the liquefied natural gas storage tanker, and iii) the converted hydrocarbon carrier-vessel.

6. The liquefied natural gas export terminal according to claim 1, wherein the converted hydrocarbon carrier-vessel further comprises one or more of living quarters, maintenance facilities, safety systems, emergency escape and evacuation systems, logistic systems and power generation.

7. The liquefied natural gas export terminal according to claim 1, wherein the converted oil tanker is a converted very large crude carrier.

8. The liquefied natural gas export terminal according to claim 1, wherein the second pipeline is a cryogenic hose.

9. The liquefied natural gas export terminal according to claim 1, wherein the converted hydrocarbon carrier-vessel is moored against the jetty with a longitudinal axis of the converted hydrocarbon carrier-vessel parallel to a portion of the first pipe line which runs along the jetty.

10. The liquefied natural gas export terminal according to claim 1, wherein mooring lines connect the converted hydrocarbon carrier-vessel to the portion of the jetty extending from the coastline and the portion of the jetty extending parallel to the coastline.

11. The liquefied natural gas export terminal according to claim 1, wherein the liquefied natural gas storage unit is moored directly against the converted hydrocarbon carrier-vessel on a side of the hydrocarbon carrier-vessel opposite the jetty.

12. A method of forming a liquefied natural gas export terminal according to claim 1, the method comprising:

converting the oil tanker or the liquefied natural gas carrier into the converted hydrocarbon carrier-vessel with the hull and the natural gas processing system;

mooring the converted hydrocarbon carrier-vessel directly against the portion of the jetty such that the converted hydrocarbon carrier-vessel extends parallel to the shore on the shore side of the second portion of the jetty;

extending the first pipeline from the shore to the converted hydrocarbon carrier-vessel on the jetty;

arranging the outlet on the second portion of the jetty on a side opposite the side on which the converted hydrocarbon carrier-vessel is moored for export of liquefied natural gas to the tanker moored on that side of the second portion of the jetty; and connecting the outlet to the converted hydrocarbon carrier-vessel and/or the liquefied natural gas storage unit.

13. The method of claim 12, and further comprising: mooring the liquefied natural gas storage unit to the converted hydrocarbon carrier-vessel on the side opposite the side which the converted hydrocarbon carrier-vessel is moored to the jetty.

14. The method of claim 12, and further comprising connecting the liquefied natural gas storage unit to the converted hydrocarbon carrier-vessel for transferring the liquefied natural gas between the liquefied natural gas storage unit and the converted hydrocarbon carrier-vessel.

15. The method of claim 12, and further comprising connecting the liquefied natural gas storage unit to the outlet.

16. The method of claim 12, wherein the step of mooring the converted hydrocarbon carrier-vessel to the second portion of the jetty such that the converted hydrocarbon carrier-vessel extends parallel to the shore on the shore side of the second portion of the jetty comprises connecting stern mooring lines between the converted hydrocarbon carrier-vessel and the first portion of the jetty and connecting mooring lines between the converted hydrocarbon carrier-vessel and the second portion of the jetty.

* * * * *